US009217303B2

(12) United States Patent
Aarhus et al.

(10) Patent No.: US 9,217,303 B2
(45) Date of Patent: Dec. 22, 2015

(54) APPARATUS FOR CONNECTING OR DISCONNECTING A THREADED COUPLING BETWEEN TWO RISER JOINTS

(75) Inventors: Jon Olav Aarhus, Sauda (NO); Øystein Windsland, Sandnes (NO)

(73) Assignee: Vetco Gray Scandinavia AS, Sandvika (NO)

( * ) Notice: Subject to any disclaimer, the term of this patent is extended or adjusted under 35 U.S.C. 154(b) by 488 days.

(21) Appl. No.: 13/703,492

(22) PCT Filed: Jun. 10, 2011

(86) PCT No.: PCT/IB2011/001297

§ 371 (c)(1),
(2), (4) Date: Mar. 26, 2013

(87) PCT Pub. No.: WO2011/154817

PCT Pub. Date: Dec. 15, 2011

(65) Prior Publication Data

US 2013/0192427 A1 Aug. 1, 2013

(30) Foreign Application Priority Data

Jun. 11, 2010 (NO) ..... 20100839

(51) Int. Cl.
*E21B 19/16* (2006.01)
*B25B 21/00* (2006.01)

(52) U.S. Cl.
CPC ..... *E21B 19/16* (2013.01); *B25B 21/002* (2013.01); *E21B 19/168* (2013.01)

(58) Field of Classification Search
CPC ..... B25B 21/00; B25B 21/002; B25B 17/00; B25B 21/004; B25B 13/488; B25B 23/0078; E21B 19/16; E21B 19/168
See application file for complete search history.

(56) References Cited

U.S. PATENT DOCUMENTS

| | | | | |
|---|---|---|---|---|
| 3,179,180 | A | 4/1965 | Hart | |
| 3,196,717 | A * | 7/1965 | Sheppard | 81/57.2 |
| 6,237,445 | B1 * | 5/2001 | Wesch, Jr. | 81/57.18 |
| 6,298,926 | B1 | 10/2001 | Dalkert et al. | |
| 6,374,706 | B1 | 4/2002 | Newman | |
| 2005/0006103 | A1 | 1/2005 | McGuire et al. | |
| 2005/0056122 | A1 * | 3/2005 | Belik | 81/57.16 |
| 2005/0242512 | A1 | 11/2005 | Flindall | |

OTHER PUBLICATIONS

Int'l Search Report and Written Opinion (PCT/IB2011/001297), dated Sep. 27, 2011.

* cited by examiner

*Primary Examiner* — Robert Scruggs
(74) *Attorney, Agent, or Firm* — Bracewell & Giuliani LLP

(57) ABSTRACT

An apparatus for connecting or disconnecting a threaded coupling between two riser joints, comprising: —a frame (11) provided with a space (12) for receiving the coupling; —a first drive wheel set (20) carried by the frame and comprising one or more drive wheels (21, 22) driven by a first drive motor (23) for rotating a main nut of the coupling; and —a second drive wheel set (40) carried by the frame and comprising one or more drive wheels (41, 42) driven by a second drive motor (43) for rotating a locking nut of the coupling. The drive wheels of the second drive wheel set are located on a level above the drive wheels of the first drive wheel set to allow them to engage with and rotate the locking nut when the drive wheels of the first drive wheel set are in engagement with the main nut.

17 Claims, 9 Drawing Sheets

APPARATUS FOR CONNECTING OR DISCONNECTING A THREADED COUPLING BETWEEN TWO RISER JOINTS

FIELD OF THE INVENTION AND PRIOR ART

The present invention relates to an apparatus for connecting or disconnecting a threaded coupling between two riser joints of a completion and work over riser where the threaded coupling is of the type having a main nut with a locking nut located above the main nut.

A completion and work over riser may be of the monobore type or the dual bore type. A dual bore riser comprises a production pipe and an annulus pipe extending in parallel with the production pipe. The production pipe is designed for taking a load and has strength for lifting, whereas the annulus pipe is just a pressure containing pipe with no strength for lifting. A monobore riser comprises a production pipe but no annulus pipe.

A completion and work over riser is used in the oil and gas industry when oil and/or gas is to be extracted from one or more offshore wells. Completion and work over operations are performed on a subsea wellhead using a completion and work over riser. A completion and work over riser may for instance be used for installing or retrieving a so-called X-mas tree. It may also be used for installing or pulling a tubing hanger in a wellhead. With a dual bore riser it will be possible to circulate a fluid down through the production pipe and up through the annulus pipe or vice versa. Such fluid circulation is used to clean a well and to test and verify a circulation path. The bore of the production pipe and the bore of the annulus pipe of a dual bore riser may be connected to two corresponding bores in an X-mas tree so that a wire line or coiled tubing can be used to access plugs or other devices installed in the bores of the X-mas tree. The bore of the production pipe of a riser may also be connected to the production tubing that extends from a tubing hanger all the way to the bottom of a well. Installing the tubing and tubing hanger is referred to as completing a well and is consequently a completion operation. When a well is completed, it is made ready for production of oil and/or gas or alternatively for injection of fluids. If the well does not produce as expected, it may be overhauled or repaired in different ways. This is referred to as work over.

Two riser joints of a completion and work over riser may be connected to each other by means of a threaded coupling having a main nut with a locking nut located above the main nut. The threaded coupling is provided on the production pipe. When the two riser joints are to be connected, the upper riser joint is positioned above the lower riser joint and the lower end of the upper riser joint is lowered down into contact with the upper end of the lower riser joint. The main nut is then rotated to spin it in, whereupon the main nut is tightened by applying the required torque to it by means of a suitable torque tool. Thereafter, the locking nut is rotated to spin it in, whereupon the locking nut is tightened by applying the required torque to it by means of a suitable torque tool.

SUMMARY OF THE INVENTION

The object of the present invention is to make possible a safe and efficient connecting or disconnecting of a threaded coupling between two riser joints of a completion and work over riser where the threaded coupling is of the type having a main nut with a locking nut located above the main nut.

According to the invention, this object is achieved by an apparatus having the features defined in claim 1.

The apparatus of the present invention comprises:

- a frame, which is provided with a space for receiving said threaded coupling;
- a first drive wheel set, which is carried by the frame and comprises one or more rotatable drive wheels for rotating the main nut of said threaded coupling in order to spin in the main nut and tighten it with the required torque or release and spin out the main nut;
- a first drive motor carried by the frame for rotating said one or more drive wheels of the first drive wheel set;
- a second drive wheel set, which is carried by the frame and comprises one or more rotatable drive wheels for rotating the locking nut of said threaded coupling in order to spin in the locking nut and tighten it with the required torque or release and spin out the locking nut; and
- a second drive motor carried by the frame for rotating said one or more drive wheels of the second drive wheel set.

Said one or more drive wheels of the second drive wheel set are located on a level above said one or more drive wheels of the first drive wheel set so as to thereby allow said one or more drive wheels of the second drive wheel set to engage with and rotate the locking nut of said threaded coupling when said one or more drive wheels of the first drive wheel set are in engagement with the main nut of the threaded coupling.

With the apparatus according to the invention, one and the same drive motor is used to spin in a nut of the threaded coupling and to tighten it with the required torque. Hereby, the apparatus can be given a simple and cost-effective design. By having two different and individually driven drive wheel sets arranged on different levels in the vertical direction, it will also be possible to spin in and tighten the locking nut directly after the main nut when the threaded coupling is connected or to release and spin out the main nut directly after the locking nut when the threaded coupling is disconnected, without having to reposition the apparatus or its drive wheels. Thus, the operations for connecting and disconnecting the threaded coupling can be performed in a rapid and safe manner. A further advantage is that the torque can be maintained to the main nut by means of the first drive wheel set during the spinning in and tightening of the locking nut.

Further advantages as well as advantageous features of the apparatus according to the present invention will appear from the following description and the dependent claims.

BRIEF DESCRIPTION OF THE DRAWINGS

With reference to the appended drawings, a specific description of preferred embodiments of the invention cited as examples follows below. In the drawings.

DETAILED DESCRIPTION OF PREFERRED EMBODIMENTS OF THE INVENTION

Figure 1:
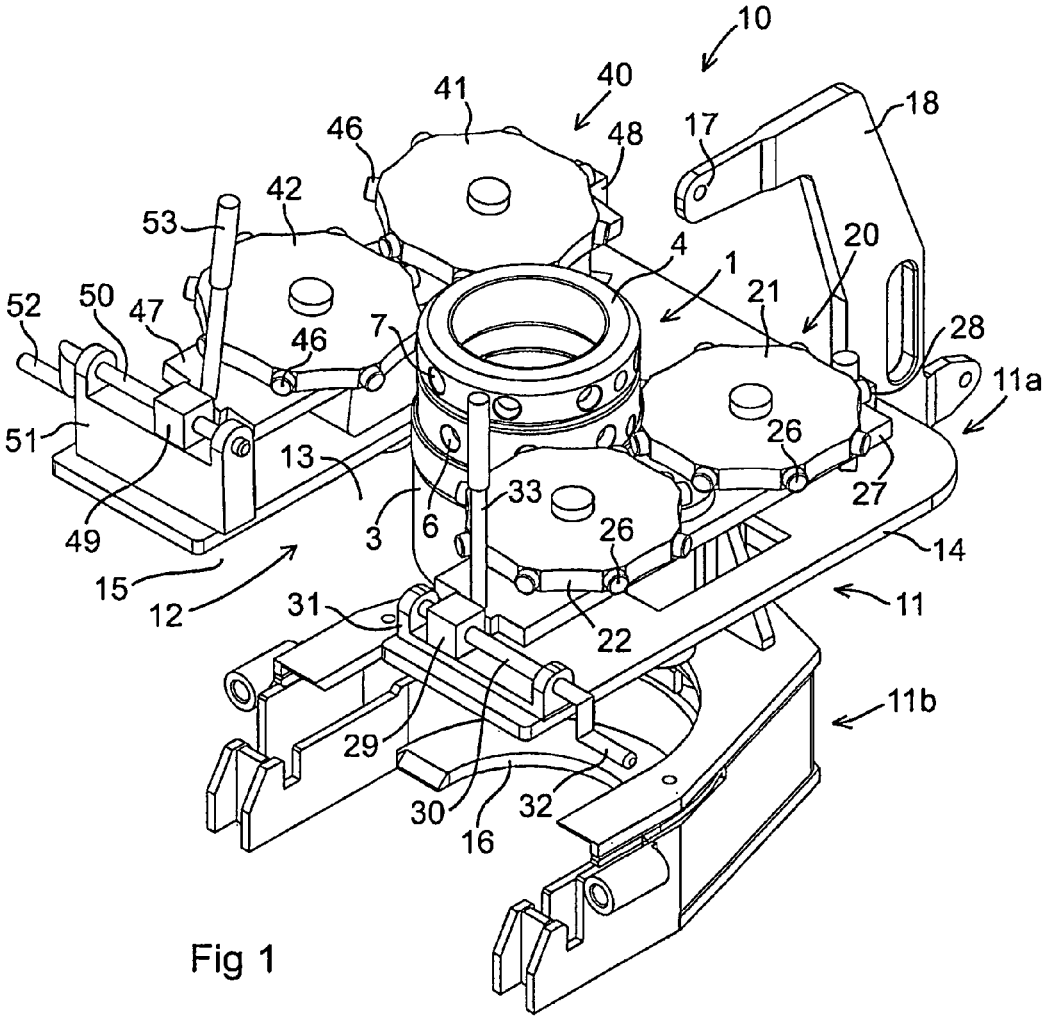
FIG. 1 is a perspective view of an apparatus according to a first embodiment of the present invention, with the drive wheels of the apparatus in engagement with the main nut and locking nut of a threaded coupling.
Figure 2:
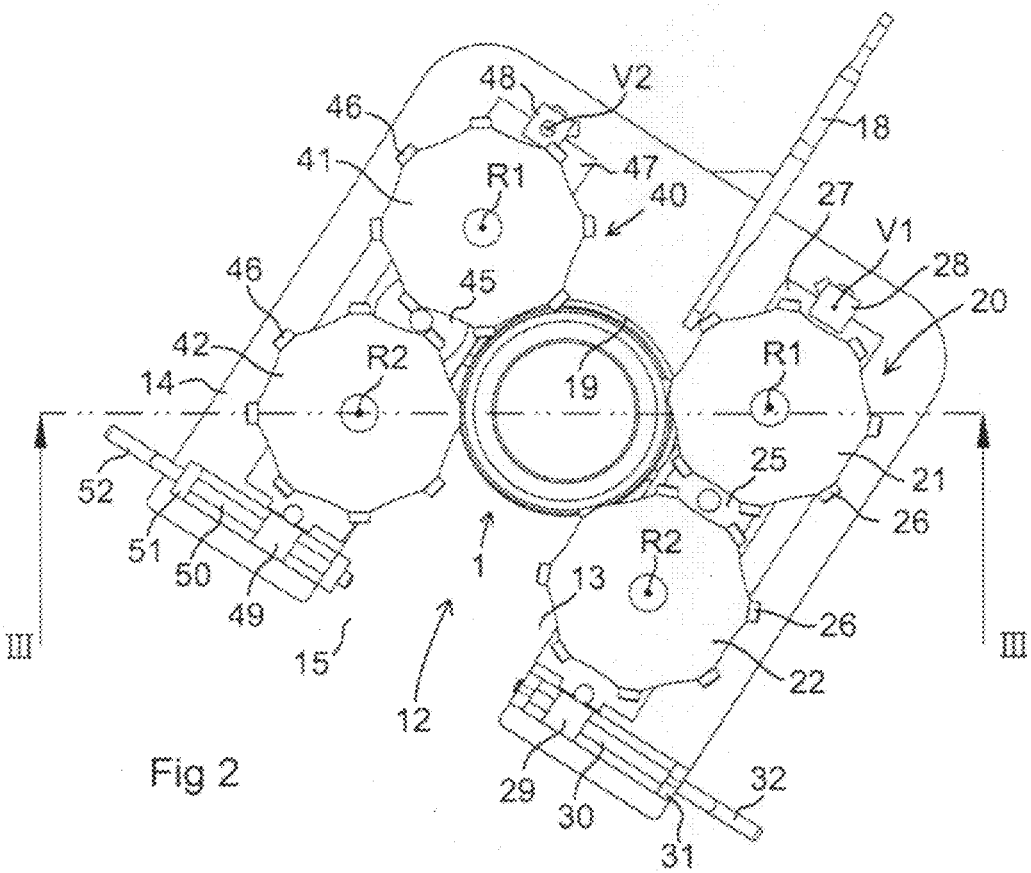
FIG. 2 is a planar view from above of the apparatus of FIG. 1, with the drive wheels of the apparatus in engagement with the main nut and locking nut of a threaded coupling.
Figure 3:
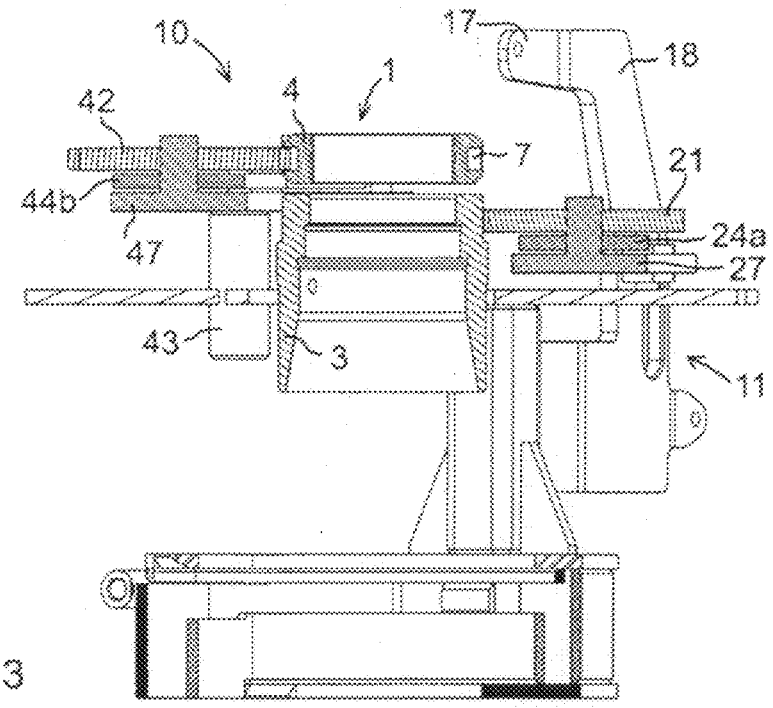
FIG. 3 is a cut according to the line in FIG. 2.
Figure 4:
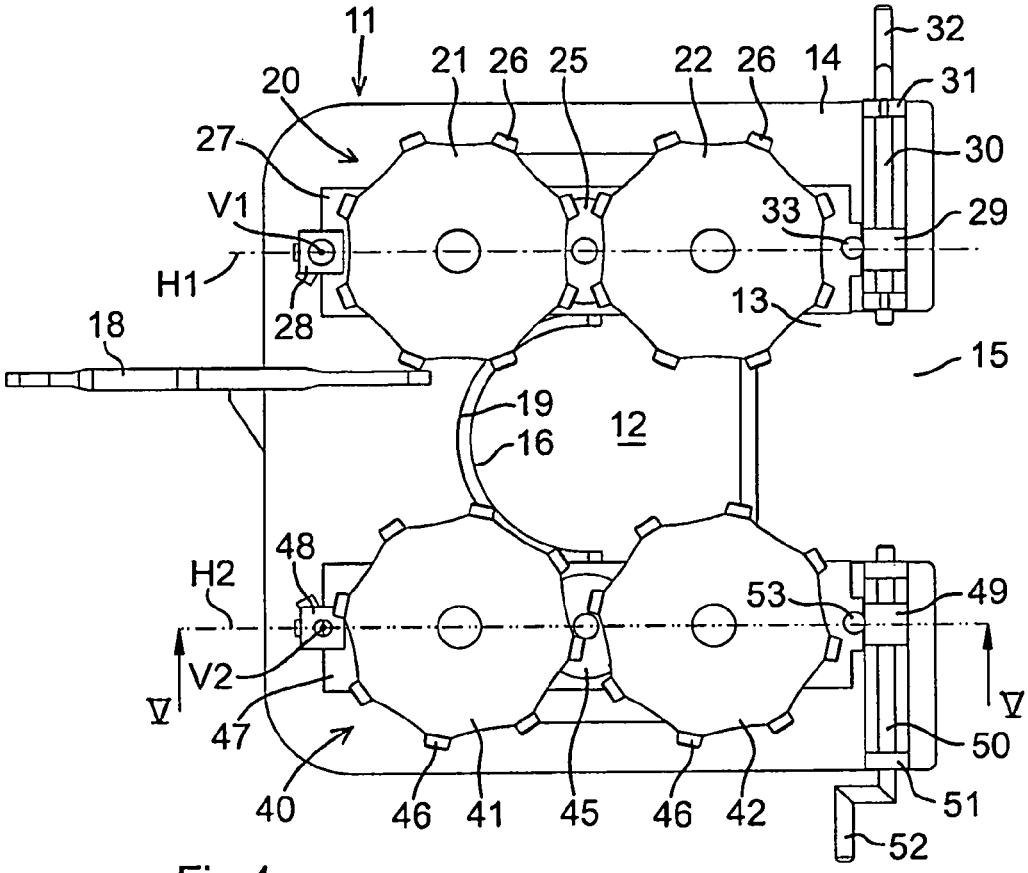
FIG. 4 is a planar view from above of the apparatus of FIG. 1.
Figure 5:
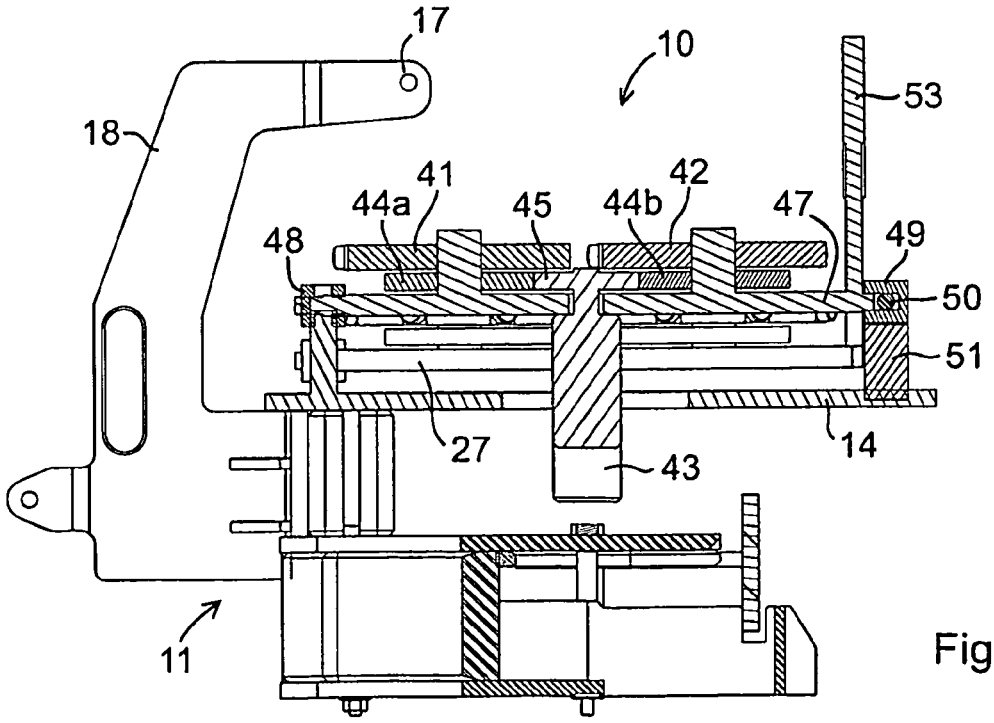
FIG. 5 is a cut according to the line V-V in FIG. 4.
Figure 7A:
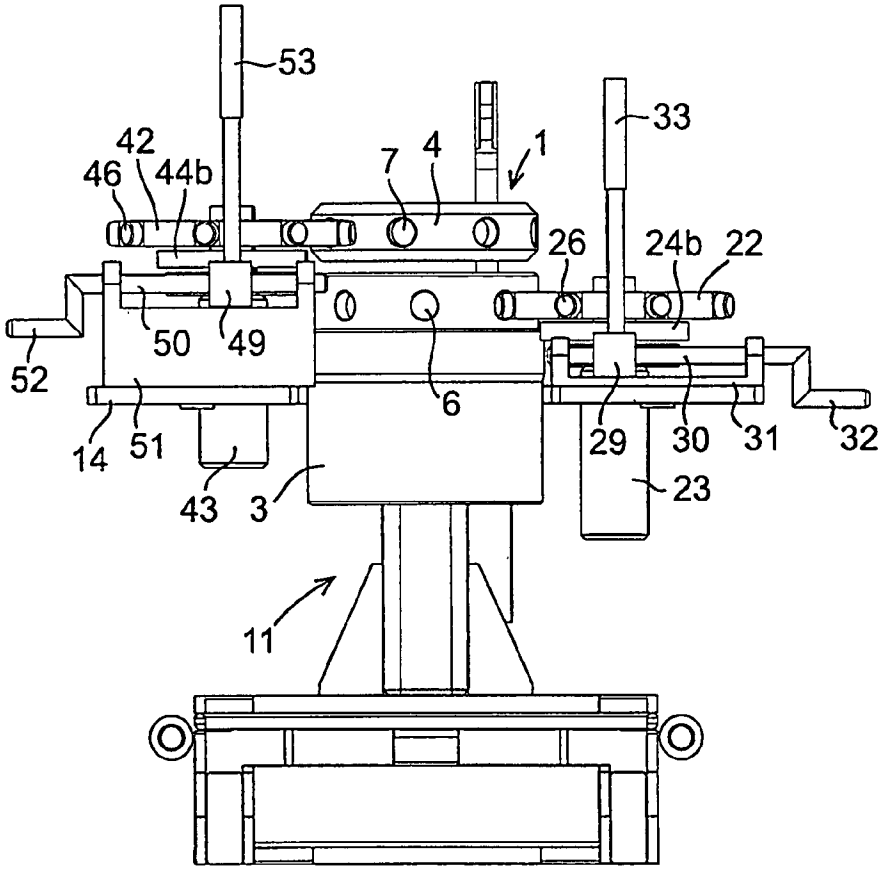

An apparatus 10 according to a first embodiment of the present invention is illustrated in FIGS. 1-7. This apparatus 10 is to be used for connecting or disconnecting a threaded coupling 1 between a lower riser joint 2*a* and an upper riser joint 2*b* (see FIG. 6) of a completion and work over riser where the threaded coupling is of the type having a main nut 3 with a locking nut 4 located above the main nut. The main nut 3 is usually denominated Swivel Box and the locking nut 4 is usually denominated Jam Nut. The apparatus 10 is particularly to be used for connecting or disconnecting a threaded coupling 1 between the production pipes 5*a*, 5*b* of two dual bore riser joints 2*a*, 2*b*.

The apparatus 10 comprises a frame 11, which is provided with a space 12 for receiving said threaded coupling 1. Said space 12 is formed by a recess 13 in a support plate 14 included in an upper part 11*a* of the frame. In FIGS. 1-3 and 7*a*-7*c*, the apparatus 10 is shown with the main nut 3 and locking nut 4 of a threaded coupling received in said space 12 of the frame. The two riser joints that are to be interconnected by means of these nuts 3, 4 are omitted in FIGS. 1-3 and 7*a*-7*c* for the sake of clarity. The recess 13 has a lateral entrance opening 15 to allow said threaded coupling 1 to be received in the space 12 via the entrance opening 15 by moving the frame 11 over the threaded coupling in the radial direction thereof. The frame 11 also includes a lower part 11*b*, which is provided with a guide member 16 intended to engage with the outer surface of the lower riser joint 2*a* in order to make sure that the frame 11 is correctly positioned in relation to the riser joints 2*a*, 2*b* and the threaded coupling 1 between the riser joints.

The frame 11 carries a first drive wheel set 20 arranged on a first side of the space 12 for rotating the main nut 3 of the threaded coupling 1 in order to spin in the main nut and tighten it with the required torque or release and spin out the main nut. The frame also carries a second drive wheel set 40 arranged on the opposite side of the space 12 for rotating the locking nut 4 of the threaded coupling 1 in order to spin in the locking nut and tighten it with the required torque or release and spin out the locking nut. In the embodiment illustrated in FIGS. 1-7, the respective drive wheel set comprises a first drive wheel 21, 41 and a second drive wheel 22, 42, the axis of rotation R1 of the first drive wheel 21, 41 extending at a distance from and in parallel with the axis of rotation R2 of the second drive wheel 22, 42. The two drive wheels 41, 42 of the second drive wheel set are located on a level above the two drive wheels 21, 22 of the first drive wheel set so as to thereby allow the drive wheels 41, 42 of the second drive wheel set to engage with and rotate the locking nut 4 when the drive wheels 21, 22 of the first drive wheel set are in engagement with the main nut 3.

The two drive wheels 21, 22 of the first drive wheel set are driven in rotation by a first reversible drive motor 23 carried by the frame 11 and the two drive wheels 41, 42 of the second drive wheel set are driven in rotation by a second reversible drive motor 43 carried by the frame 11. The respective drive motor 23, 43 is a pneumatically or hydraulically operated torque motor. Each drive wheel 21, 22, 41, 42 is non-rotatably connected to a gear wheel 24*a*, 24*b* 44*a*, 44*b*, and the output shaft of the respective drive motor 23, 43 is connected to a gear wheel 25, 45 which is in engagement with the gear wheel 24*a*, 44*a* of the first drive wheel 21, 41 and the gear wheel 24*b*, 44*b* of the second drive wheel 22, 42 of the associated drive wheel set. The first drive motor 23 is arranged to rotate the two drive wheels 21, 22 of the first drive wheel set in the same direction via the gear wheel 25 connected to the output shaft of the drive motor and the gear wheels 24*a*, 24*b* connected to the drive wheels 21, 22. The second drive motor 43 is arranged to rotate the two drive wheels 41, 42 of the second drive wheel set in the same direction via the gear wheel 45 connected to the output shaft of the drive motor and the gear wheels 44*a*, 44*b* connected to the drive wheels 41, 42.

In the embodiment illustrated in FIGS. 1-7, the respective drive wheel 21, 22 of the first drive wheel set is provided with pegs 26, which are distributed along the circumference of the drive wheel and designed for engagement with corresponding holes 6 distributed along the circumference of the main nut 3. The respective drive wheel 41, 42 of the second drive wheel set is also provided with pegs 46, which are distributed along the circumference of the drive wheel and designed for engagement with corresponding holes 7 distributed along the circumference of the locking nut 4.

The two drive wheels 21, 22 of the first drive wheel set are rotatably mounted to a first holder unit 27, which is pivotally mounted to the frame 11. The first drive motor 23 is also mounted to this first holder unit 27. The first holder unit 27 is pivotable in relation to the frame 11 about a horizontal pivot axis H1 (see FIG. 4) to allow the drive wheels 21, 22 to be tilted in relation to the frame about this horizontal pivot axis H1. The two drive wheels 41, 42 of the second drive wheel set are rotatably mounted to a second holder unit 47, which is pivotally mounted to the frame 11. The second drive motor 43 is also mounted to this second holder unit 47. The second holder unit 47 is pivotable in relation to the frame 11 about a horizontal pivot axis H2 (see FIG. 4) to allow the drive wheels 41, 42 to be tilted in relation to the frame about this horizontal pivot axis H2.

The respective holder unit 27, 47 is displaceably mounted to the frame 11 so as to be horizontally displaceable in relation to the frame 11 and thereby allow the drive wheels 21, 22, 41, 42 to be horizontally displaced to and fro between a retracted position out of engagement with a threaded coupling 1 received in the space 12 of the frame 11 and an advanced position in engagement with said threaded coupling. In the illustrated example, the respective holder unit 27, 47 has the form of a plate and is at one end pivotally mounted to a first support member 28, 48 and at its other end pivotally mounted to a second support member 29, 49 so as to be pivotable in relation to said first and second support members 28, 29, 48, 49 about a horizontal pivot axis H1, H2. The respective first support member 28, 48 is in its turn pivotally mounted to the support plate 14 so as to be pivotable in relation to the frame 11 about a vertical pivot axis V1, V2 (see FIGS. 2 and 4). The respective second support member 29, 49 is displaceable along a threaded rod 30, 50, which extends through a threaded hole in the support member. The respective rod 30, 50 is rotatably mounted to a holder 31, 51, which is rigidly connected to the support plate 14. The respective rod 30, 50 is fixed in axial direction to the associated holder 31, 51 and is connected to a crank 32, 52, by means of which the rod 30, 50 can be manually rotated by an operator. When the rod 30, 50 is rotated in a first direction, the associated second support member 29, 49 is displaced in a first direction along the rod, and when the rod 30, 50 is rotated in the opposite direction, the associated second support member 29, 49 is displaced in the opposite direction along the rod. Thus, the respective holder unit 27, 47 and the drive wheels 21, 22, 41, 42 carried by the holder unit can be horizontally displaced in relation to the frame 11 by being pivoted about the vertical pivot axis V1, V2 when the second support member 29, 49 is displaced along the rod 30, 50 by a rotation of the crank 32, 52. A control rod 33, 53 is fixed to the respective holder unit 27, 47 so as to allow the holder unit and the drive wheels 21, 22, 41, 42 carried by the holder unit to be pivoted in relation to the frame 11 about the horizontal axis H1, H2 by manually pivoting the control rod 33, 53 in the desired direction.

The apparatus 10 may be suspended from a crane or other supporting device through a wire (not shown), which is attached to an attachment 17 at the outer end of a lifting arm 18 fixed to the frame 11.

The apparatus 10 is designed in such a manner that the drive wheels 21, 22, 41, 42 can be made to engage with and rotate the main nut 3 and locking nut 4 of a threaded coupling 1 between the production pipes 5*a*, 5*b* of two dual bore riser joints 2*a*, 2*b* without interfering with the annulus bores 8*a*, 8*b* of the riser joints.

Figure 6:
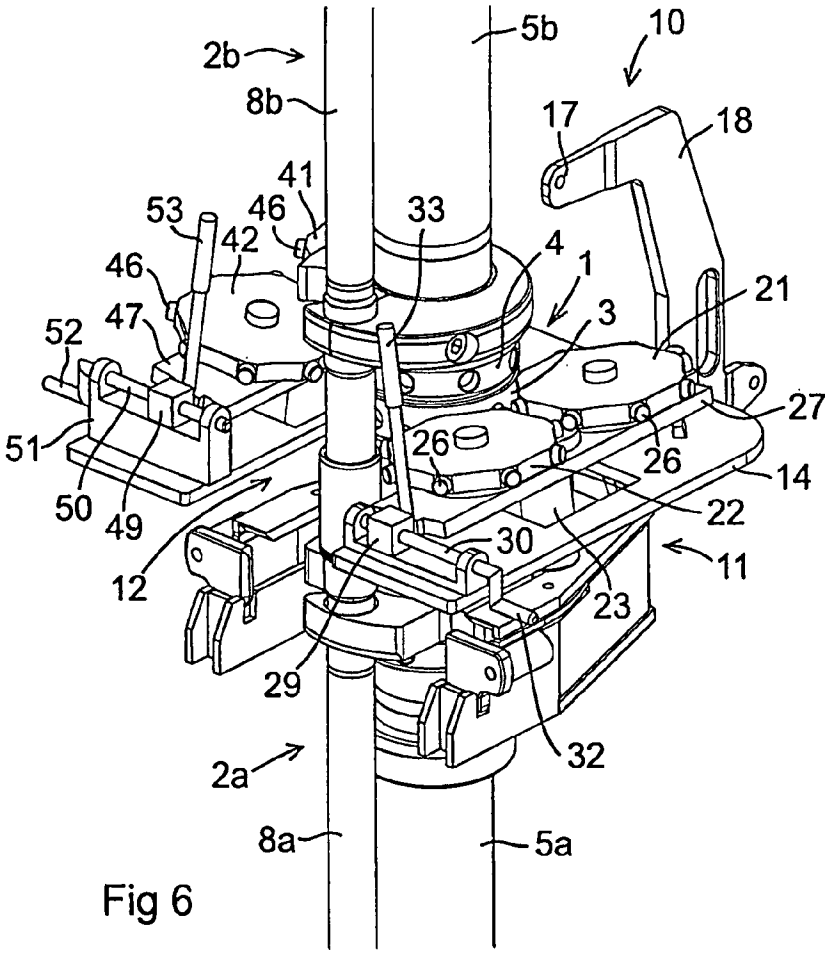
FIG. 6 is a perspective view illustrating a step in the process of connecting a threaded coupling between two dual bore riser joints by means of the apparatus of FIG. 1, FIGS. 7*a-c* are front views illustrating different steps in the process of connecting a threaded coupling by means of the apparatus of FIG. 1.
Figure 7C:
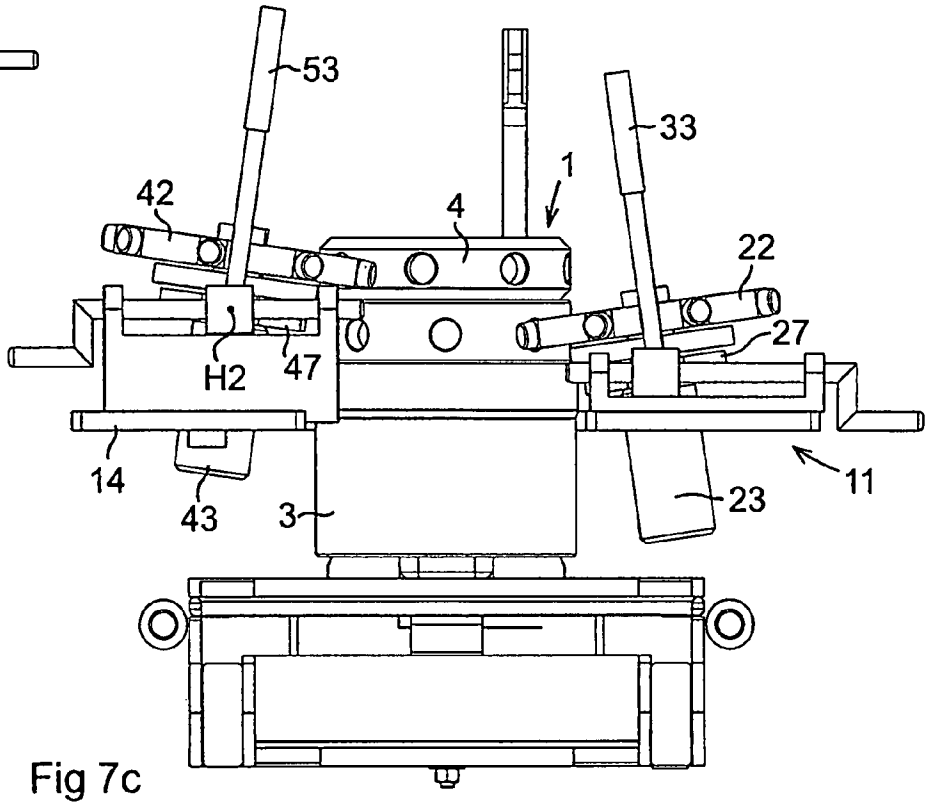
Figure 7B:
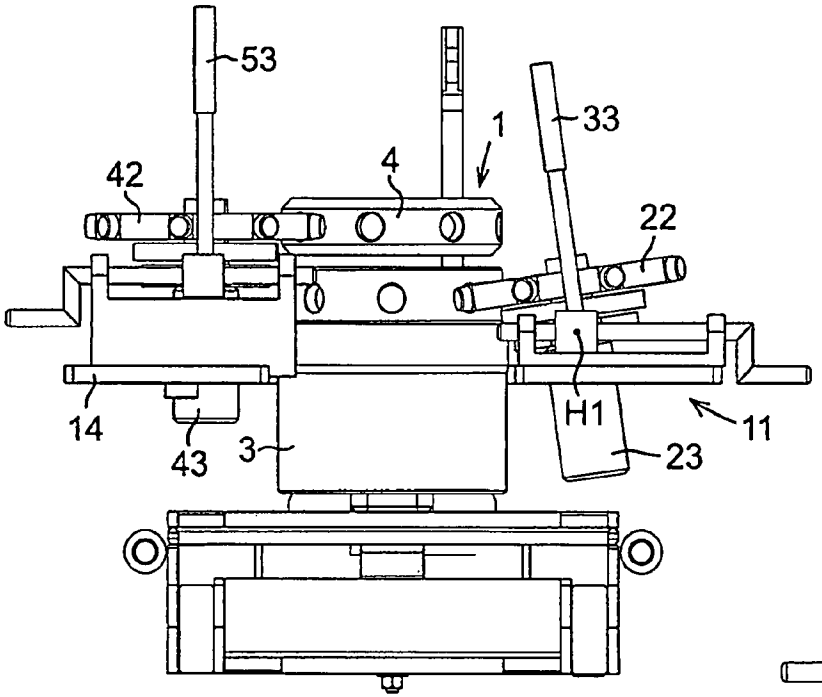

When two riser joints 2*a*, 2*b* are to be connected to each other, a coupling part at the lower end of the upper riser joint 2*b* is positioned above a corresponding coupling part at the upper end of the lower riser joint 2*a* and said coupling parts are brought into contact with each other. The apparatus 10 is then positioned in front of the threaded coupling 1 between the riser joints with the lateral entrance opening 15 of the space 12 in the frame 11 facing the production pipes 5*a*, 5*b* of the riser joints, whereupon the apparatus 10 is moved laterally towards the threaded coupling 1 so as to make the threaded coupling to enter into the space 12 of the frame. The frame 11 is correctly positioned in relation to the threaded coupling 1 when the envelope surface of the threaded coupling abuts against a guide surface 19 at the inner end of the recess 13 in the support plate 14 and the lower riser joint 2*a* abuts against the guide member 16 of the lower frame part 11*b*. In this position, the annulus pipes 8*a*, 8*b* of the riser joints 2*a*, 2*b* face away from said guide surface 19 and guide member 16, as illustrated in FIG. 6. The cranks 32, 52 are then rotated and the control rods 33, 53 are pivoted in order to move the drive wheels 21, 22, 41, 42 towards the nuts 3, 4 in such a manner that the pegs 26 of the drive wheels 21, 22 of the first drive wheel set are brought into engagement with the corresponding holes 6 in the envelope surface of the main nut 3 and the pegs 46 of the drive wheels 41, 42 of the second drive wheel set are brought into engagement with the corresponding holes 7 in the envelope surface of the locking nut 4. Thereafter, the first drive motor 23 is operated to rotate the drive wheels 21, 22 of the first drive wheel set in order to spin in the main nut 3, whereupon the main nut 3 is tightened by applying the required torque to it by means of the first drive motor 23. During the spinning in of the main nut 3, the drive wheels 21, 22 of the first drive wheel set will tilt about the horizontal axis H1 together with the first holder unit 27, as illustrated in FIG. 7*b*. In the next step, the second drive motor 43 is operated to rotate the drive wheels 41, 42 of the second drive wheel set in order to spin in the locking nut 4, whereupon the locking nut 4 is tightened by applying the required torque to it by means of the second drive motor 43. During the spinning in of the locking nut 4, the drive wheels 41, 42 of the second drive wheel set will tilt about the horizontal axis H2 together with the second holder unit 47, as illustrated in FIG. 7*c*. During the spinning in and tightening of the locking nut 4, the torque is maintained to the main nut 3 by means of the drive wheels 21, 22 of the first drive wheel set and the first drive motor 23. Finally, the drive wheels 21, 22, 41, 42 are released from the nuts 3, 4 by maneuvering of the cranks 32, 52 and the control rods 33, 53 and the apparatus 10 is moved away from the riser joints 2*a*, 2*b*. The apparatus 10 can be used in a corresponding manner in order to disconnect a threaded coupling 1 between two riser joints 2*a*, 2*b*.

An apparatus 10' according to a second embodiment of the present invention is illustrated in FIGS. 8-12. This apparatus 10' is to be used for connecting or disconnecting a threaded coupling 1 between a lower riser joint 2*a* and an upper riser joint 2*b* (see FIG. 8) of a completion and work over riser where the threaded coupling is of the type having a main nut 3 with a locking nut 4 located above the main nut. The apparatus 10' is particularly to be used for connecting or disconnecting a threaded coupling 1 between the production pipes 5*a*, 5*b* of two dual bore riser joints 2*a*, 2*b*.

The apparatus 10' comprises a frame 11, which is provided with a space 12 for receiving said threaded coupling 1. Said space 12 has an upper opening 15*a* formed by a recess 13*a* in an upper support plate 14*a* included in the frame 11 and a lower opening 15*b* formed by a recess 13*b* in a lower support plate 14*b* included in the frame 11. Furthermore, the space 12 has a lateral opening 15*c* extending along the space 12 between said upper and lower openings 15*a*, 15*b*. A slot 16*a*, 1.6*b* designed to receive the annulus bore 8*a*, 8*b* of a riser joint is provided at the inner end of the respective recess 13*a*, 13*b*.

The frame 11 carries a first drive wheel set 20 with a drive wheel 21 rotatably mounted to the frame on a first side of the space 12 for rotating the main nut 3 of the threaded coupling 1 in order to spin in the main nut and tighten it with the required torque or release and spin out the main nut. The frame 11 also carries a second drive wheel set 40 with a drive wheel 41 rotatably mounted to the frame on the opposite second side of the space 12 for rotating the locking nut 4 of the threaded coupling 1 in order to spin in the locking nut and tighten it with the required torque or release and spin out the locking nut. The drive wheel 21 of the first drive wheel set is driven in rotation by a first reversible drive motor 23 carried by the frame 11 and the drive wheel 41 of the second drive wheel set is driven in rotation by a second reversible drive motor 43 carried by the frame 11. The respective drive motor 23, 43 is a pneumatically or hydraulically operated torque motor.

Figure 9:
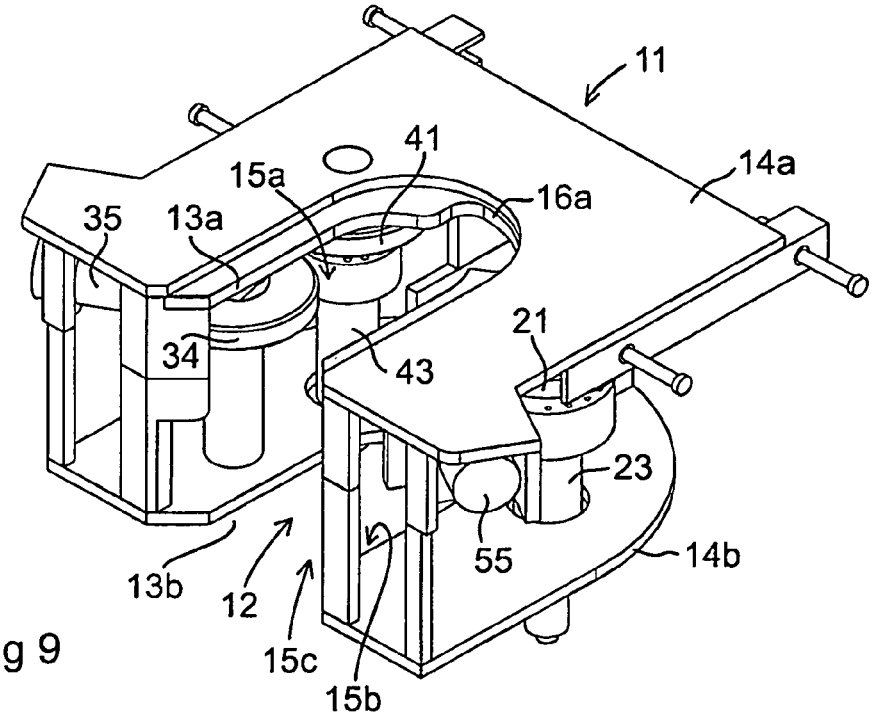
FIG. 9 is a perspective view of a part of the apparatus of FIG. 8.
Figure 10:
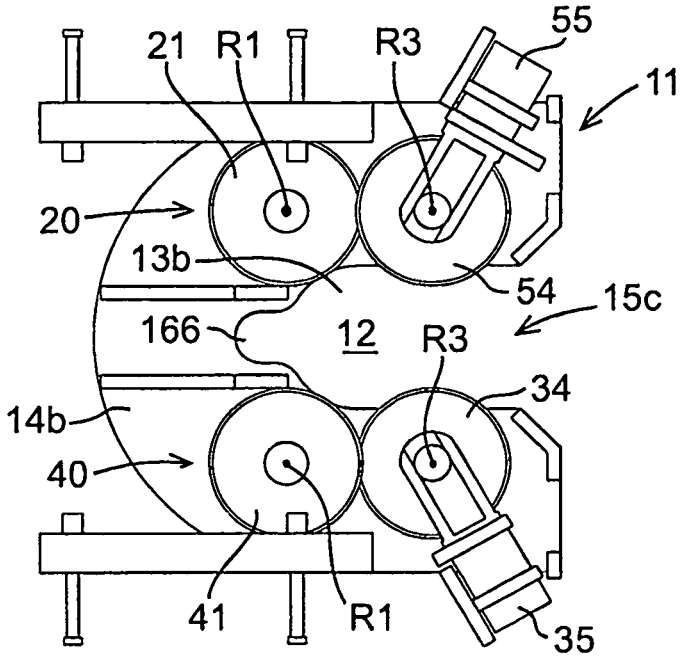
FIG. 10 is a planar view from above of the part illustrated in FIG. 9, with an upper plate of the frame removed.
Figure 11:
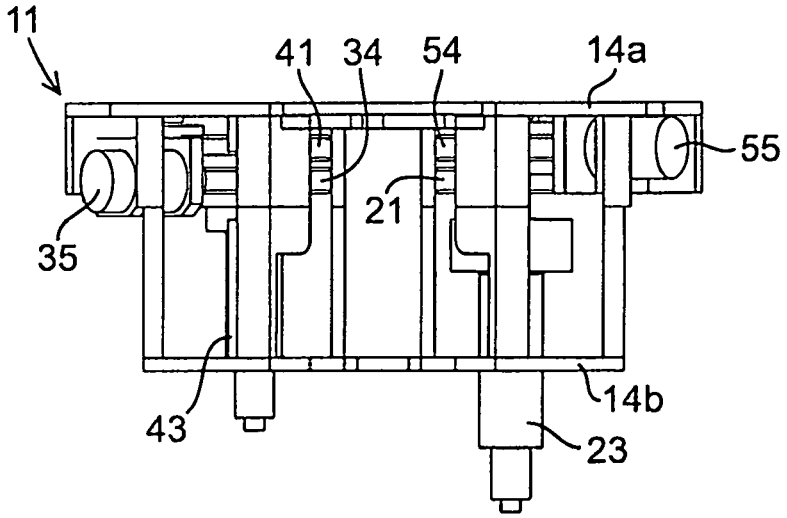
FIG. 11 is a front view of the part illustrated in FIG. 9, and FIG. 12*a-c* are lateral views illustrating different steps in the process of connecting a threaded coupling by means of the apparatus of FIG. 8.

A first mating wheel 34 is rotatably mounted to the frame 11 at the lateral opening 15*c* on said second side of the space 12 (see FIGS. 9-11). This first mating wheel 34 is horizontally displaceable in relation to the frame 11 against the action of a spring force from an advanced position to a retracted position. A second mating wheel 54 is rotatably mounted to the frame 11 at the lateral opening 15*c* on said first side of the space 12. This second mating wheel 54 is horizontally displaceable in relation to the frame 11 against the action of a spring force from an advanced position to a retracted position. The respective mating wheel 34, 54 has an axis of rotation R3 (see FIG. 10) which extends in parallel with the axis of rotation R1 of the respective drive wheel 21, 41. The first mating wheel 34 is arranged on the same vertical level in the frame 11 as the drive wheel 21 of the first drive wheel set, whereas the second mating wheel 54 is arranged on the same vertical level in the frame 11 as the drive wheel 41 of the second drive wheel set.

The first mating wheel 34 is connected to a first hydraulic cylinder 35 mounted to the frame 11 and the second mating wheel 54 is connected to a second hydraulic cylinder 55 mounted to the frame 11. The first mating wheel 34 is displaceable in the direction towards the drive wheel 21 of the first drive wheel set under the action of the first hydraulic cylinder 35 in order to press the main nut 3 against this drive wheel 21. The second mating wheel 54 is displaceable in the direction towards the drive wheel 41 of the second drive wheel set under the action of the second hydraulic cylinder 55 in order to press the locking nut 4 against this drive wheel 41. The above-mentioned spring force acting on the first mating wheel 34 is exerted by a spring included in the first hydraulic cylinder 35, and the above-mentioned spring force acting on the second mating wheel 54 is exerted by a spring included in the second hydraulic cylinder 55.

Figure 8:
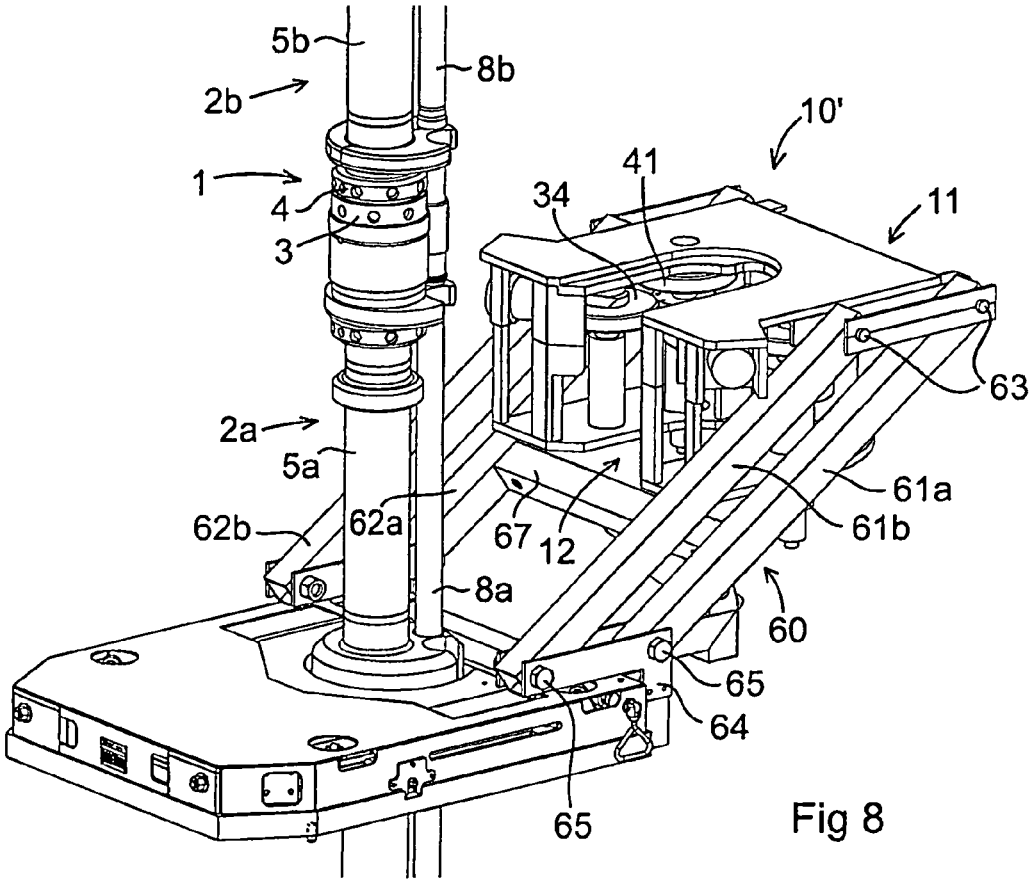
FIG. 8 is a perspective view of an apparatus according to a second embodiment of the invention.
Figure 12B:
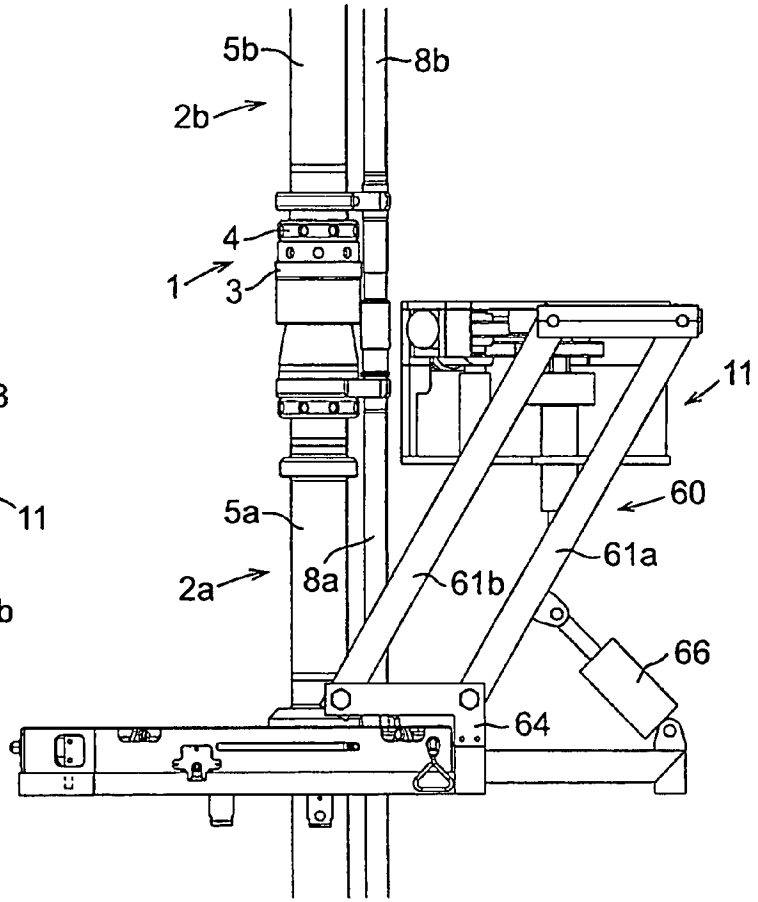
Figure 12A:
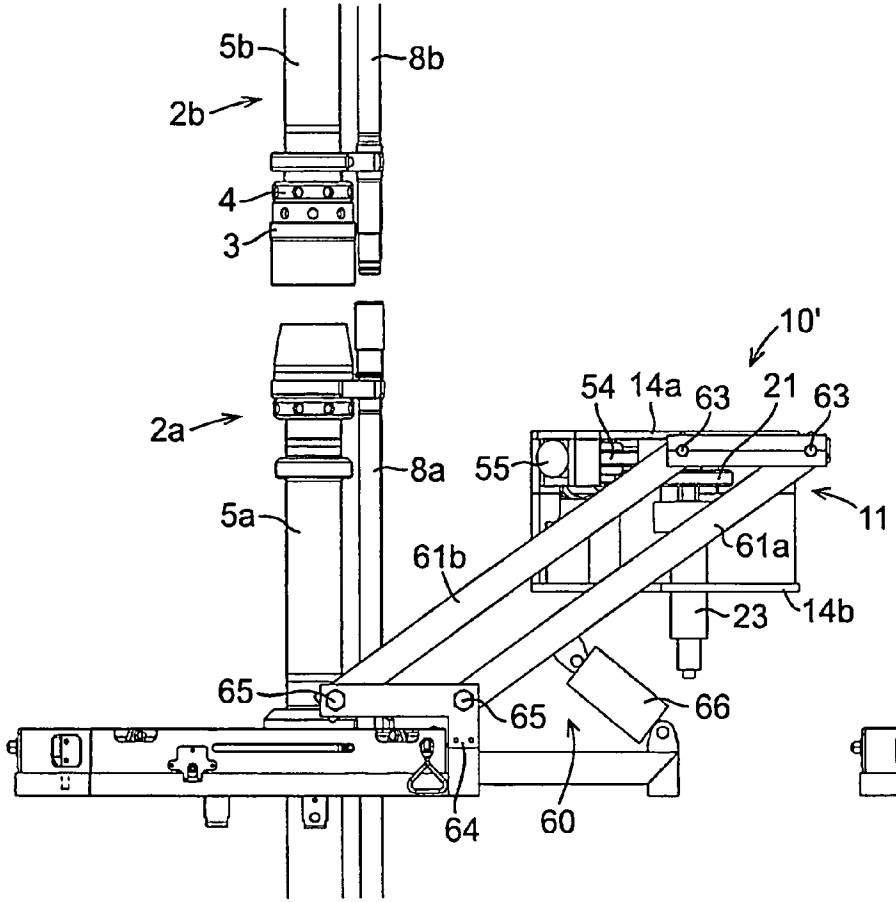
Figure 12C:
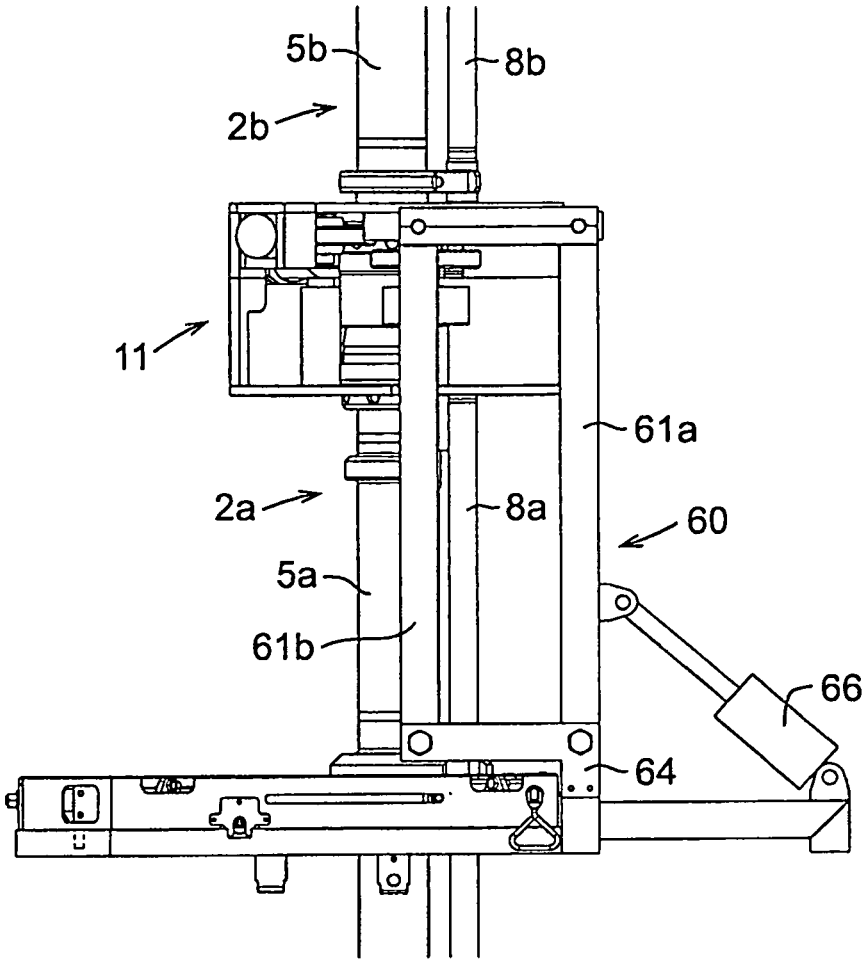

In the embodiment illustrated in FIGS. 8-12, the frame 11 is carried by a swing arm unit 60, by means of which the frame 11 is moveable to and fro between an advanced working position (see FIG. 12*c*) and a retracted resting position (see FIG. 12*a*). In the illustrated example, the swing arm unit 60 comprises two parallel links 61*a*, 61*b* arranged on a first side of the frame 11 and two parallel links 62*a*, 62*b* arranged on the opposite side of the frame, as illustrated in FIG. 8. The respective link 61*a*, 61*b*, 62*a*, 62*b* is articulately connected to the frame 11 via a first joint 63 at a first end of the link and articulately connected to a base 64 via a second joint 65 at the opposite end of the link. The swing arm unit 60 is actuated by means of a hydraulic cylinder 66, which at one end is articulately connected to the base 64 and at the other end is articulately connected to a cross bar 67 extending between a link 61*a* on a first side of the frame 11 and a link 62*a* on the opposite side of the frame 11. The swing arm unit 60 is pivotable in relation to the base 64 by means of the hydraulic cylinder 66 so as to thereby move the frame 11 between the working position and the resting position.

The apparatus 10' is designed in such a manner that the drive wheels 21, 41 can be made to engage with and rotate the main nut 3 and locking nut 4 of a threaded coupling 1 between the production pipes 5*a*, 5*b* of two dual bore riser joints 2*a*, 2*b* without interfering with the annulus bores 8*a*, 8*b* of the riser joints.

When two riser joints 2*a*, 2*b* are to be connected to each other, a coupling part at the lower end of the upper riser joint 2*b* is positioned above a corresponding coupling part at the upper end of the lower riser joint 2*a* and said coupling parts are brought into contact with each other. The frame 11 is moved by means of the swing arm unit 60 from the resting position (see FIG. 12*a*) to a position in front of the threaded coupling 1 between the riser joints with the lateral opening 15*c* of the space 12 in the frame 11 facing the annulus pipes 8*a*, 8*b* of the riser joints (see FIG. 12*b*), whereupon the frame 11 is moved towards the threaded coupling 1 so as to make the threaded coupling to enter into the space 12 of the frame. When the threaded coupling 1 comes into contact with the mating wheels 34, 54, it will force the mating wheels 34, 54 apart against the spring force exerted on the respective mating wheel so as to thereby allow the threaded coupling to enter into the space 12. The frame 11 is correctly positioned in relation to the threaded coupling 1 when an annulus pipe has been received in the slot 16*a*, 16*b* of the respective support plate 14*a*, 14*b*. The first mating wheel 34 will press the main nut 3 against the drive wheel 21 of the first drive wheel set under the action of the first hydraulic cylinder 35 and the first drive motor 23 is operated to rotate the drive wheel 21 in order to spin in the main nut 3, whereupon the main nut 3 is tightened by applying the required torque to it by means of the first drive motor 23. In the next step, the second drive motor 43 is operated to rotate the drive wheel 41 of the second drive wheel set in order to spin in the locking nut 4, whereupon the locking nut 4 is tightened by applying the required torque to it by means of the second drive motor 43. During the spinning in and tightening of the locking nut 4, the second mating wheel 54 presses the locking nut 4 against the drive wheel 41 of the second drive wheel set under the action of the second hydraulic cylinder 55. During the spinning in and tightening of the locking nut 4, the torque is maintained to the main nut 3 by means of the drive wheel 21 of the first drive wheel set and the first drive motor 23. Finally, the frame 11 is moved away from the riser joints 2*a*, 2*b* by means of the swing arm unit 60 from the working position to the resting position, as illustrated in FIG. 8. The apparatus 10' can be used in a corresponding manner in order to disconnect a threaded coupling 1 between two riser joints 2*a*, 2*b*.

The invention is of course not in; any way restricted to the embodiments described above. On the contrary, many possibilities to modifications thereof will be apparent to a person with ordinary skill in the art without departing from the basic idea of the invention such as defined in the appended claims.

The invention claimed is:

1. An apparatus for connecting or disconnecting a threaded coupling between two riser joints of a completion and work over riser where the threaded coupling is of the type having a main nut with a locking nut located above the main nut, wherein the apparatus comprises:

a frame, which is provided with a space for receiving the threaded coupling;

a first drive wheel set, which is carried by the frame and comprises one or more rotatable drive wheels for rotating the main nut of the threaded coupling in order to spin in the main nut and tighten it with the required torque or release and spin out the main nut;

a first drive motor carried by the frame for rotating the one or more drive wheels of the first drive wheel set;

a second drive wheel set, which is carried by the frame and comprises one or more rotatable drive wheels for rotating the locking nut of the threaded coupling in order to spin in the locking nut and tighten it with the required torque or release and spin out the locking nut; and a second drive motor carried by the frame for rotating the one or more drive wheels of the second drive wheel set, the second drive motor separately operable from the first drive motor to individually drive the second drive wheel set independent of the first drive wheel set;

and wherein the one or more drive wheels of the second drive wheel set are located on a level above the one or more drive wheels of the first drive wheel set so as to thereby allow the one or more drive wheels of the second drive wheel set to engage with and rotate the locking nut of the threaded coupling when the one or more drive wheels of the first drive wheel set are in engagement with the main nut of the threaded coupling.

2. An apparatus according to claim 1, wherein:

the one or more drive wheels of the first drive wheel set are rotatably mounted to a first holder unit, which is pivotally mounted to the frame, the first holder unit being pivotable in relation to the frame about a first horizontal pivot axis to allow the one or more drive wheels of the first drive wheel set to be tilted in relation to the frame about the first horizontal pivot axis; and the one or more drive wheels of the second drive wheel set are rotatably mounted to a second holder unit, which is pivotally mounted to the frame, the second holder unit being pivotable in relation to the frame about a second horizontal pivot axis to allow the one or more drive wheels of the second drive wheel set to be tilted in relation to the frame about the second horizontal pivot axis.

3. An apparatus according to claim 2, wherein the first holder unit is displaceably mounted to the frame, the first holder unit being horizontally displaceable in relation to the frame to allow the one or more drive wheels of the first drive wheel set to be horizontally displaced to and fro between a retracted position out of engagement with a threaded coupling received in the space of the frame and an advanced position in engagement with the threaded coupling.

4. An apparatus according to claim 2, wherein the second holder unit is displaceably mounted to the frame, the second holder unit being horizontally displaceable in relation to the frame to allow the one or more drive wheels of the second drive wheel set to be horizontally displaced to and fro between a retracted position out of engagement with a threaded coupling received in the space of the frame and an advanced position in engagement with the threaded coupling.

5. An apparatus according to claim 2, wherein the first drive motor is mounted to the first holder unit, and that the second drive motor is mounted to the second holder unit.

6. An apparatus according to claim 1, wherein the respective drive wheel set comprises a first drive wheel and a second drive wheel, the axis of rotation of the first drive wheel extending at a distance from and in parallel with the axis of rotation of the second drive wheel.

7. An apparatus according to claim 6, wherein:

a first gear wheel is non-rotatably connected to the first drive wheel and a second gear wheel is non-rotatably connected to the second drive wheel of the respective drive wheel set; and a gear wheel connected to the output shaft of the drive motor associated with the drive wheel set is in engagement with the first and second gear wheels to allow the drive motor to actuate the first and second drive wheels of the drive wheel set through these gear wheels.

8. An apparatus according to claim 1, wherein:

the respective drive wheel of the first drive wheel set is provided with pegs, which are distributed along the circumference of the drive wheel and designed for engagement with corresponding holes distributed along the circumference of the main nut; and the respective drive wheel of the second drive wheel set is provided with pegs, which are distributed along the circumference of the drive wheel and designed for engagement with corresponding holes distributed along the circumference of the locking nut.

9. An apparatus according to claim 1, wherein:

the space in the frame has an upper opening, a lower opening and a lateral opening, the lateral opening extending along the space between the upper and lower openings;

that the first drive wheel set comprises a drive wheel rotatably mounted to the frame on a first side of the space;

that the second drive wheel set comprises a drive wheel rotatably mounted to the frame on the opposite second side of the space;

that a first mating wheel is rotatably mounted to the frame at the lateral opening on the second side of the space; and that a second mating wheel is rotatably mounted to the frame at the lateral opening on the first side of the space.

10. An apparatus according to claim 9, wherein the respective mating wheel is horizontally displaceable in relation to the frame against the action of a spring force from an advanced position to a retracted position.

11. An apparatus according to claim 9, wherein:

the first mating wheel is arranged on the same vertical level in the frame as the drive wheel of the first drive wheel set; and the second mating wheel is arranged on the same vertical level in the frame as the drive wheel of the second drive wheel set.

12. An apparatus according to claim 9, wherein:

the apparatus comprises a first hydraulic cylinder mounted to the frame, the first mating wheel being displaceable in the direction towards the drive wheel of the first drive wheel set under the action of the first hydraulic cylinder in order to press the main nut against this drive wheel; and the apparatus comprises a second hydraulic cylinder mounted to the frame, the second mating wheel being displaceable in the direction towards the drive wheel of the second drive wheel set under the action of the second hydraulic cylinder in order to press the locking nut against this drive wheel.

13. An apparatus according to claim 9, wherein the apparatus comprises a swing arm unit, which carries the frame and by means of which the frame is moveable to and fro between an advanced working position and a retracted resting position.

14. An apparatus according to claim 13, wherein that the swing arm unit comprises two parallel links arranged on a first side of the frame and two parallel links arranged on the opposite side of the frame, the respective link being articulately connected to the frame at a first end and articulately connected to a base at its opposite end.

15. An apparatus according to claim 1, wherein the respective drive motor is a pneumatically or hydraulically operated torque motor.

16. An apparatus for connecting or disconnecting a threaded coupling between two riser joints of a completion and work over riser where the threaded coupling is of the type having a main nut with a locking nut located above the main nut, wherein the apparatus comprises:

a frame, which is provided with a space for receiving the threaded coupling;

a first drive wheel set, which is carried by the frame and comprises one or more rotatable drive wheels for rotating the main nut of the threaded coupling in order to spin in the main nut and tighten it with the required torque or release and spin out the main nut;

a first drive motor carried by the frame for rotating the one or more drive wheels of the first drive wheel set;

a second drive wheel set, which is carried by the frame and comprises one or more rotatable drive wheels for rotating the locking nut of the threaded coupling in order to spin in the locking nut and tighten it with the required torque or release and spin out the locking nut; and a second drive motor carried by the frame for rotating the one or more drive wheels of the second drive wheel set;

and wherein the one or more drive wheels of the second drive wheel set are located on a level above the one or more drive wheels of the first drive wheel set so as to thereby allow the one or more drive wheels of the second drive wheel set to engage with and rotate the locking nut of the threaded coupling when the one or more drive wheels of the first drive wheel set are in engagement with the main nut of the threaded coupling;

wherein the one or more drive wheels of the first drive wheel set are rotatably mounted to a first holder unit, which is pivotally mounted to the frame, the first holder unit being pivotable in relation to the frame about a first horizontal pivot axis to allow the one or more drive wheels of the first drive wheel set to be tilted in relation to the frame about the first horizontal pivot axis; and wherein the one or more drive wheels of the second drive wheel set are rotatably mounted to a second holder unit, which is pivotally mounted to the frame, the second holder unit being pivotable in relation to the frame about a second horizontal pivot axis to allow the one or more drive wheels of the second drive wheel set to be tilted in relation to the frame about the second horizontal pivot axis.

17. An apparatus for connecting or disconnecting a threaded coupling between two riser joints of a completion and work over riser where the threaded coupling is of the type having a main nut with a locking nut located above the main nut, wherein the apparatus comprises:

a frame, which is provided with a space for receiving the threaded coupling;

a first drive wheel set, which is carried by the frame and comprises one or more rotatable drive wheels for rotating the main nut of the threaded coupling in order to spin in the main nut and tighten it with the required torque or release and spin out the main nut;

a first drive motor carried by the frame for rotating the one or more drive wheels of the first drive wheel set;

a second drive wheel set, which is carried by the frame and comprises one or more rotatable drive wheels for rotating the locking nut of the threaded coupling in order to spin in the locking nut and tighten it with the required torque or release and spin out the locking nut; and a second drive motor carried by the frame for rotating the one or more drive wheels of the second drive wheel set;

wherein the one or more drive wheels of the second drive wheel set are located on a level above the one or more drive wheels of the first drive wheel set so as to thereby allow the one or more drive wheels of the second drive wheel set to engage with and rotate the locking nut of the threaded coupling when the one or more drive wheels of the first drive wheel set are in engagement with the main nut of the threaded coupling, wherein the space in the frame has an upper opening, a lower opening and a lateral opening, the lateral opening extending along the space between the upper and lower openings;

wherein the first drive wheel set comprises a drive wheel rotatably mounted to the frame on a first side of the space;

wherein the second drive wheel set comprises a drive wheel rotatably mounted to the frame on the opposite second side of the space;

wherein a first mating wheel is rotatably mounted to the frame at the lateral opening on the second side of the space;

wherein a second mating wheel is rotatably mounted to the frame at the lateral opening on the first side of the space;

wherein the apparatus comprises a swing arm unit, which carries the frame and by means of which the frame is moveable to and fro between an advanced working position and a retracted resting position; and wherein that the swing arm unit comprises two parallel links arranged on a first side of the frame and two parallel links arranged on the opposite side of the frame, the respective link being articulately connected to the frame at a first end and articulately connected to a base at its opposite end.

* * * * *